United States Patent [19]

Brownlee et al.

[11] 4,037,780

[45] July 26, 1977

[54] LOCKING LETTER TRAY

[75] Inventors: Sherwood S. Brownlee, Waynesboro; Fred H. Grubb, Stuarts Draft; Richard C. Smith, Charlottesville, all of Va.

[73] Assignee: Acme Visible Records, Inc., Crozet, Va.

[21] Appl. No.: 673,638

[22] Filed: Apr. 5, 1976

[51] Int. Cl.[2] ..... E05B 65/46; B65D 55/14

[52] U.S. Cl. ..... 232/31; 70/63; 211/126

[58] Field of Search ..... 312/215–218; 232/21, 31, 43.1, 43.4, 44, 45; 211/11, 126; 70/63, 78, 85

[56] References Cited

U.S. PATENT DOCUMENTS

| | | | |
|---|---|---|---|
| 453,879 | 6/1891 | Burns | 70/63 |
| 749,154 | 1/1904 | Benton | 232/45 |
| 901,409 | 10/1908 | Woolums | 70/63 |
| 3,144,134 | 8/1964 | Frommgen | 211/126 |

*Primary Examiner*—Casmir A. Nunberg
*Attorney, Agent, or Firm*—Gary, Juettner & Pyle

[57] ABSTRACT

A locking letter tray for receiving letters, documents or the like, and for preventing unauthorized access thereto, is characterized by a unitary structure forming an essentially closed compartment having an elongated narrow slot through a side wall thereof and a lockable door, and an open compartment juxtaposed and sharing a common wall therewith. The slot is sufficiently long and wide for the passage of documents therethrough and into the closed compartment, but is narrow enough to prevent hands from entering, and may be equipped with baffles to inhibit removal of documents by dumping, shaking, probing etc. The lockable door precludes unauthorized access to the closed compartment to provide security for documents therein, and the open compartment may advantageously be used for incoming or outgoing nonconfidential mail.

7 Claims, 3 Drawing Figures

LOCKING LETTER TRAY

BACKGROUND OF THE INVENTION

The present invention relates to letter trays, and in particular to a locking letter tray which precludes unauthorized access to mail therein.

Interoffice mail is customarily deposited in and removed from letter trays situated on the tops of desks. The trays are normally paired in an in-out arrangement, either as two separate trays positioned side by side or assembled in tiers as by supporting one tray above the other on legs or rods extended between the trays. Such trays are relatively open so that mail contained therein is readily accessible.

In certain cases, such as where the person receiving delivery of the mail is an executive, personnel manager or professor, some or all of the mail may be confidential. During the time that such person is away from his desk, confidential communications which accumulate in his letter tray are susceptible to unauthorized reading. It is therefore extremely desirable to provide a letter tray, for use in such cases, which provides security for documents therein to prevent unauthorized reading thereof, and yet is esthetically compatable with an office environment for desk top use.

Accordingly, it is an object of the present invention to provide a letter tray which affords security to documents or the like therein.

Another object of the invention is to provide such a letter tray having a lockable closure for containing mail, which is openable by authorized personnel.

A further object of the invention is to provide a letter tray having a lockable closure into which documents or the like may be readily inserted when the closure is locked, but which must be unlocked for removal of the documents.

Yet another object of the invention is to provide a letter tray having a lockable closed container portion in combination with an open container portion.

A still further object of the invention is to provide such a letter tray having a unitary structure which is esthetically compatable for desk top use in an office environment.

SUMMARY OF THE INVENTION

In accordance with the present invention, an in-out type letter tray for containing correspondence and the like includes a housing having a rectangular base wall, a rectangular top wall, and side walls extending between and secured to the edges of the base and top walls and forming a closed rectangular compartment therewith. One of the side walls has a narrow, elongated slot formed therethrough toward and parallel to the top wall to accommodate movement therethrough of correspondence into the compartment. Another of the side walls opposite from the one wall has an enlarged opening formed therein to accommodate removal of correspondence from the compartment. A door is pivotally hinged on opposite sides thereof for movement through the enlarged opening from a closed position blocking the opening to an open position within the compartment to clear the opening, and a lock is selectively operable to secure the door in its closed position to preclude access to correspondence in the compartment through the opening.

Preferably, the side walls extend beyond the top wall to define therewith an open compartment juxtaposed and having a common wall with the closed compartment, the lock is a key lock, and the base and side walls are formed with flanges extending parallel to the base wall for supporting the letter tray thereon in an upright position.

With mail or correspondence received within the closed compartment, the letter tray thus provides security against unauthorized access thereto except by someone in possession of a key for the lock, and the upper open compartment provides a convenient storage area for outgoing correspondence which is customarily sealed and therefore not susceptible to unauthorized reading.

Thus the objects of the invention are attained with particular facility and economy. Other objects, advantages and features of the invention will become apparent from the following detailed description thereof, when taken in conjunction with the appended drawings.

DETAILED DESCRIPTION

The drawings illustrate an in-out type letter locking tray configured in accordance with a preferred embodiment of the invention, particularly adapted and esthetically suited for desk top use to receive and provide security for confidential mail, documents or the like.

Figure 1:
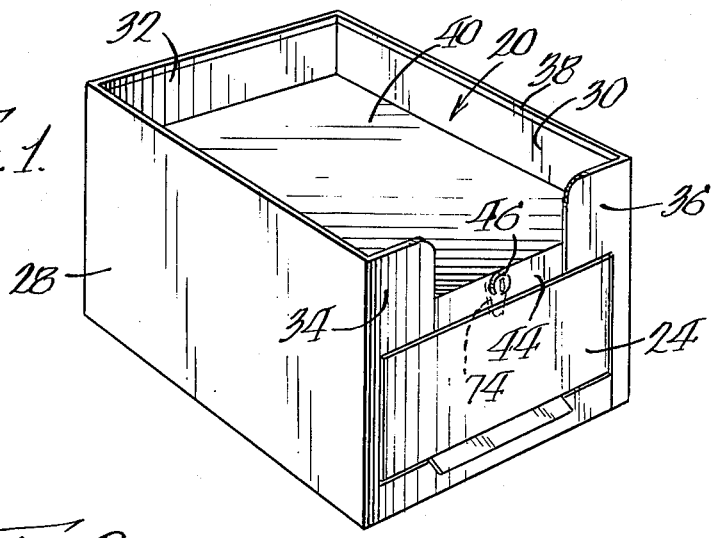
FIG. 1 is a perspective view of a locking letter tray, having a structure in accordance with a preferred embodiment of the invention.
Figure 2:
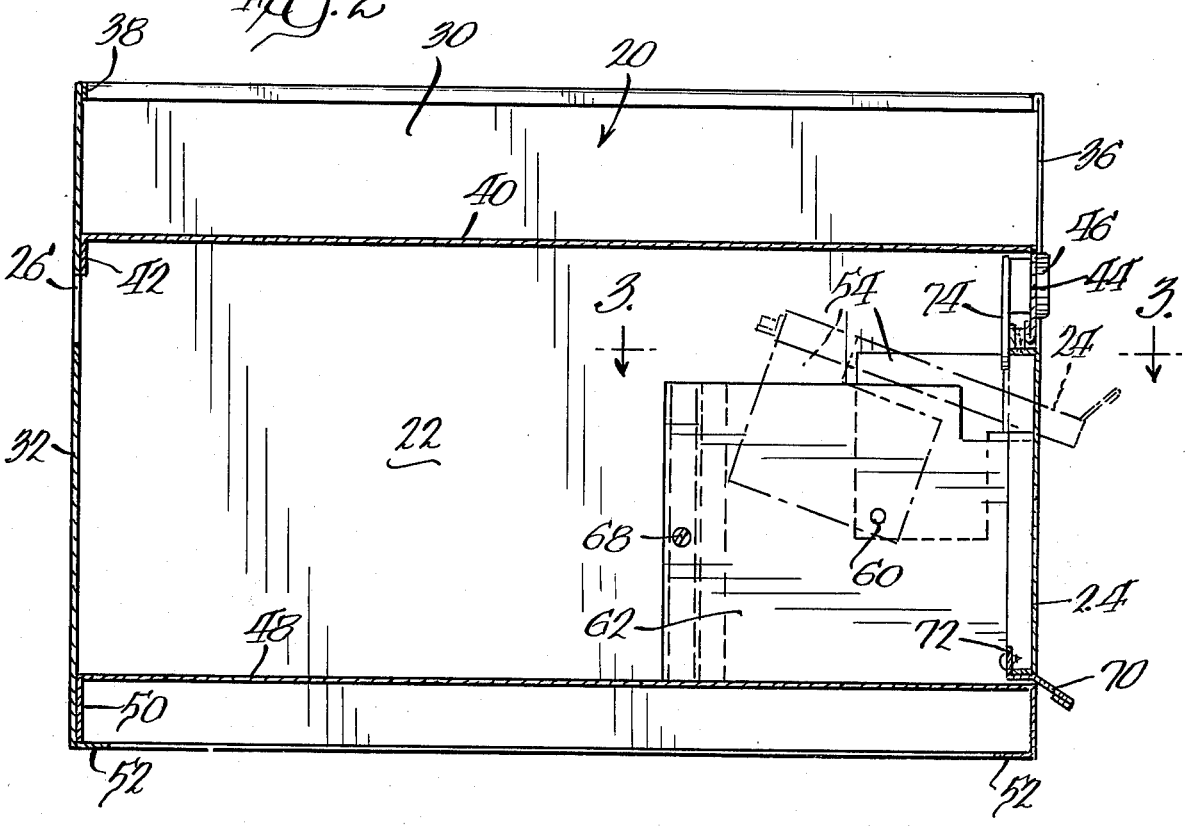
FIG. 2 is a cross-sectional side view of the letter tray of FIG. 1, particularly illustrating the lockable door thereof both in a locked and in an open position.

With reference to FIGS. 1 and 2, the letter tray is of a sturdy and economical unitary structure defining an open upper tray or compartment 20 juxaposed and sharing a common wall with a lower closed compartment 22 which is accessible as by a lockable door 24. The closed compartment is for receiving correspondence, documents or the like through an elongated slot 26, and maintains the documents secure from access except by authorized entry thereto through the door, and the tray is useful for holding sealed outgoing mail or the like, or as a shelf for conveniently holding sorted material removed from the closed compartment. As finished, the letter tray is painted in various decorative colors, and is an attractive complement to any office decor.

More particularly, the letter tray includes integral vertical wall portions defining a pair of parallel side walls 28 and 30, a rear wall 32 and a front wall including spaced wall portions 34 and 36 forming an enlarged opening therebetween which is converable by the door. The uppermost ends of the walls are folded over as at 38 to form smooth curves.

An upper horizontal panel or top wall 40 is positioned between the vertical walls spaced from the upper ends thereof, and is affixed thereat by downwardly extending edge flanges 42 abutted against and spot welded to the walls to define the open compartment 20. A flange 44 extending downward from the front edge of the panel receives centrally therein a lock 46 for the door 24, and is preferably welded at its outer ends to the wall portions 34 and 36 to increase the rigidity thereof.

A lower horizontal panel or base wall 48 is positioned between the vertical walls at the lower ends thereof, and is secured thereat by downwardly extending flanges 50 abutted against and welded to the walls. The panels 40 and 48, together with the vertical side walls and the door 24, define the closed compartment 22, with the panel 48 forming the base thereof.

With the door 24 closed, entry to the compartment 22 for letters, documents and the like is provided through the slot 26 located in the rear wall 32 toward the upper end of the compartment. The slot extends along its length parallel to the panel 40, and is long and wide enough for ready passage of documents therethrough the but narrow enough to preclude extension of a hand therethrough. Later removal of the documents from the compartment is then accomplished via the enlarged frontal opening when the door 24 is unlocked and opened. Inwardly extending flanges 52 around the lower edges of the walls 28, 30 and 32, and from the lower edge of the forward flange of the panel 48, define horizontal surfaces for resting the letter tray on a desk top, and are preferably underlined with a soft material, such as felt, to prevent scratching or otherwise marring the desk top. When positioned on a desk, the door 24 customarily faces the occupant thereof to provide access to the compartment 22, with the slot 26 facing away from the occupant for receiving delivered mail.

Figure 3:
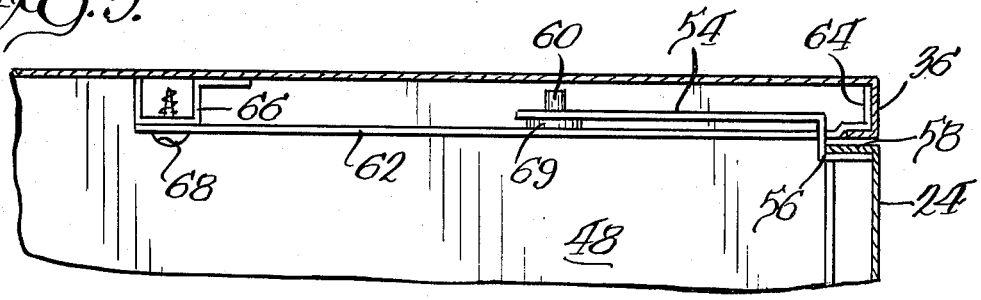
FIG. 3 is a view taken substantially along the lines 3—3 of FIG. 2, and shows an arrangement for pivotally mounting the lockable door on the tray.

The door 24 is mounted at each of its ends for pivotal movement between a closed position (shown in solid lines in FIG. 2) whereat the door closes the frontal opening and blocks entry to the compartment 22, and an open position (shown in phantom lines) whereat the door clears the opening and permits free access to the compartment. Referring also to FIG. 3, the door mounting on each side comprises a hinge plate 54 secured at one end thereof to the door as by a flange 56 welded to a complementary flange 58 of the door, and rotatably mounted toward an opposite end to a pivot pin sixty. The pivot pin is secured in a anchor plate 62, which in turn is fastened at one end thereof to the front wall portion 36 as by a flange 64 welded thereto, and at an opposite end to a bracket 66 by a screw 68. A bushing 69 on the pivot pin prevents rubbing engagement of the hinge and the anchor plate, and movement of the door between its closed and open positions is facilitated by a handle 70 fastened to a lower end of the door as by a screw 72. The handle is formed with a folded over outer edge to provide a smooth gripping surface. When moved to its open position, the door passes upper end first through the opening and is conveniently disposed in an out of the way position within the compartment 22.

The lock 46 is of the key variety, and includes a rearward arm 74 rotatable between a downward door locked position, as shown in FIG. 2, to block movement of the upper end of the door 24 into the opening, and a sideways door unlocked position upward of the door, to permit movement of the door to its open position. Accordingly, only those personnel having a key for the lock 46 may obtain access to documents within the compartment 22. To further maintain the security of the documents, the slot 26 may be provided with baffles or the like (not shown) to preclude removal thereof from the compartment as by dumping, shaking or probing.

The invention thus provides a compact, structurally sound, esthetically attractive locking letter tray particularly suited for use in an office environment for receiving documents or other correspondence, and for maintaining such secure from unauthorized reading, yet permitting convenient retrieval thereof by proper personnel.

While one particular embodiment of the invention has been described in detail, it is understood that various other modifications and embodiments thereof may be devised by one skilled in the art without departing from the spirit and the scope of the invention, as defined by the appended claims. For example, while the locking letter tray has been described as having an open tray positioned above a closed compartment and sharing a common wall therewith, the invention also contemplates an arrangement where the open tray is positioned side by side with the closed compartment and shares a common side wall therewith, or where the tray is positioned to the rear of the compartment and shares a common rear wall therewith. Furthermore, it is contemplated that instead of an open compartment for outgoing mail being provided in combination with a closed compartment for incoming mail, two lockably closed compartments of the type described could be formed one on top of the other or side by side and sharing a common wall, whereby absolute security would be obtained for both incoming and outgoing correspondence.

What is claimed is:

1. In a desk top type locking letter tray for containing correspondence and the like, a housing having a base wall, a top wall spaced therefrom and parallel thereto, and side walls extending between the edges of said base and top walls forming a closure therewith, one of said side walls having an elongated slot formed therethrough toward said top wall for movement therethrough of correspondence into said closure, and another of said side walls having an enlarged opening therethrough and a lockable door associated therewith, said side walls extending beyond said top walls and defining therebetween and with said top wall an open tray for containing correspondence, said door when locked blocking entry to said closure through said opening and when unlocked being movable to clear said opening for removal of correspondence from said closure through said opening.

2. In a letter tray as set forth in claim 1, wherein the length of said slot extends parallel to said top wall, and wherein said door is pivotally mounted for movement through said opening from a position blocking said opening to a position within said closure and clear of said opening.

3. In an in-out type letter ray for containing correspondence and the like: a housing having a rectangular base wall, a rectangular top wall, and side wall extending between and secured to the edges of said base and top walls and forming a closed rectangular compartment therewith, one of said side walls having a narrow elongated slot formed therethrough toward and parallel to said top wall for movement therethrough of correspondence into said compartment, another of said side walls opposite from said one side wall having an enlarged opening formed therein through which correspondence in said compartment may be removed; a door pivotally hinged on opposite sides thereof for movement through said enlarged opening from a closed position blocking said opening to an open position within said compartment to clear said opening; and a lock associated with said door and selectively operable to secure said door in said closed position to preclude access to correspondence in said compartment through said opening, said side walls extending beyond said top wall to define therewith an open compartment juxtaposed and having a common wall with said closed compartment.

4. In an in-out letter tray as set forth in claim 3, said door having handle secured thereto at an end thereof toward said base wall, and being hinged for movement of an opposite end thereof through said opening and into said closed compartment upon movement of said handle toward said top wall, said lock being a key lock and being operable to block movement of said opposite end of said base into said compartment to secure said door in said closed position.

5. In an in-out letter tray as set forth in claim 4, said base wall and said side walls thereat being formed with flanges extending parallel to said base wall for supporting said letter tray thereon in an upright position.

6. In an in-out letter tray as set forth in claim 4, said side walls having said enlarged opening forming a passage centrally thereof beyond the point whereat said side wall extends past said top wall to define a side opening to said open container.

7. In a desk top type locking letter tray for containing correspondence and the like, a housing having a base wall, a top wall spaced therefrom and parallel thereto, and side walls extending between the edges of said base and top walls forming a closure therewith, one of said side walls having an elongated slot formed therethrough toward said top wall for movement therethrough of correspondence into said closure, and another of said side walls having an enlarged opening therethrough and a lockable door associated therewith, said door when locked blocking entry to said closure through said opening and when unlocked being movable to clear said opening for removal of correspondence from said closure through said opening, and an open tray having a base and side walls extending therefrom, at least one of said side walls being common with at least one of said housing side walls.

* * * * *